US007181880B2

(12) United States Patent
Keeney

(10) Patent No.: US 7,181,880 B2
(45) Date of Patent: Feb. 27, 2007

(54) ROLLER SEAR/HAMMER INTERFACE FOR FIREARMS

(75) Inventor: Michael D. Keeney, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 10/973,679

(22) Filed: Oct. 26, 2004

(65) Prior Publication Data

US 2005/0246932 A1 Nov. 10, 2005

Related U.S. Application Data

(60) Provisional application No. 60/516,443, filed on Oct. 31, 2003.

(51) Int. Cl.
*F41A 19/12* (2006.01)

(52) U.S. Cl. ..... 42/69.03

(58) Field of Classification Search ..... 42/20, 42/65, 67, 69.03, 70.04, 70.05; 89/27.11, 89/139, 149, 150
See application file for complete search history.

(56) References Cited

U.S. PATENT DOCUMENTS

| | | | | |
|---|---|---|---|---|
| 94,577 | A | 9/1869 | Diaz | |
| 383,372 | A | 5/1888 | Rostel | |
| 449,711 | A | 4/1891 | Skoda | |
| 458,505 | A | 8/1891 | Skoda | |
| 1,404,001 | A | 10/1912 | Olsson | |
| 2,189,202 | A | 2/1940 | Garland | |
| 2,418,946 | A | 4/1947 | Loomis | |
| 2,462,585 | A * | 2/1949 | Wesson | 42/69.01 |
| 2,535,709 | A * | 12/1950 | Weeks | 42/69.02 |
| 2,601,808 | A | 7/1952 | Clarke | |
| 2,675,638 | A | 4/1954 | Crittendon | |
| 2,685,754 | A | 8/1954 | Crittendon et al. | |
| 2,800,657 | A | 7/1957 | Hoopes | |
| 2,926,446 | A | 3/1960 | Benson | |
| 2,976,637 | A | 3/1961 | Robinson, Jr. | |
| 2,977,855 | A | 4/1961 | Catlin et al. | |
| 3,285,133 | A | 11/1966 | Fowler | |
| 3,690,218 | A | 9/1972 | Maillard | |
| 3,726,040 | A * | 4/1973 | Cranston | 42/69.01 |
| 3,763,742 | A | 10/1973 | Kotas et al. | |
| 4,341,031 | A | 7/1982 | Palmer et al. | |
| 4,344,246 | A | 8/1982 | Bauman et al. | |

(Continued)

FOREIGN PATENT DOCUMENTS

| | | |
|---|---|---|
| BE | 524187 | 11/1953 |

(Continued)

*Primary Examiner*—Michael J. Carone
*Assistant Examiner*—Bret Hayes
(74) *Attorney, Agent, or Firm*—Womble Carlyle Sandridge & Rice, PLLC

(57) ABSTRACT

A roller sear/hammer interface for a firearm. The sear has a roller rotatably mounted between two side plates forming a portion of the sear body. As the trigger is moved, a linkage connecting the trigger and sear causes the sear to pivot rearward such that the roller engages a notched surface formed in the hammer. This rolling action releases the hammer to strike a firing pin to fire a round of ammunition. When the trigger is released, the sear roller rolls downward into an engaged and locked position within the notch formed in the hammer.

18 Claims, 3 Drawing Sheets

U.S. PATENT DOCUMENTS 4,368,590 A 1/1983 Palmer
4,389,919 A 6/1983 Kast et al.
4,462,179 A 7/1984 Rogak et al.
4,908,970 A 3/1990 Bell
2003/0070342 A1* 4/2003 Baker et al. ..... 42/69.03

FOREIGN PATENT DOCUMENTS

DE 41 25 148 A1 2/1993

* cited by examiner

ROLLER SEAR/HAMMER INTERFACE FOR FIREARMS

CROSS-REFERENCE TO RELATED APPLICATION

The present patent application is a formalization of a previously filed, co-pending provisional patent application entitled "Roller Sear/Hammer Interface for Firearms", filed Oct. 31, 2003, as U.S. Patent Application Ser. No. 60/516,443 by the inventor named in this patent application. This patent application claims the benefit of the filing date of the cited provisional patent application according to the statutes and rules governing provisional patent applications, particularly 35 U.S.C. § 119(e)(1) and 37 CFR §§ 1.78(a)(4) and (a)(5). The specification and drawings of the provisional patent application are specifically incorporated herein by reference.

FIELD OF THE INVENTION

The present invention generally relates to hammer driven firearm trigger assemblies, and in particular to a hammer/sear interface for hammer driven firearm trigger assemblies.

BACKGROUND OF THE INVENTION

In hammer driven firearm trigger assemblies or fire control systems, such as for handguns, shotguns and various other types of long guns including lever action and semi-automatic rifles, the hammer of the firearm generally is held in a cocked position by a mechanical interface with a sear. The sear is connected either directly or through mechanical linkages to the trigger of the firearm. When the trigger is squeezed or moved rearward to fire a round of ammunition, the sear generally is moved out of locking engagement with the hammer so as to release the hammer. The hammer then is pivoted into contact with a firing pin of the firearm by a hammer spring. The engagement of the firing pin by the hammer causes the firing pin to strike a round of ammunition in the chamber of the firearm to initiate the firing of a round of ammunition.

FIG. 1 generally illustrates a conventional hammer sear interface in which the sear 2 includes a notched, hooked portion 6 that engages a corresponding notch or hook 8 formed in the rear hammer 4. Due to the sliding nature of this mechanical interface, the sear 2 and hammer 4 generally must be precisely machined so as to provide and ensure smooth and even surfaces on both the hammer and sear, so as to provide a smooth and crisp trigger feel during shooting to avoid catching or hesitation during firing, which can lead to misfires and affect the aim of the shooter. In addition, it is also important for hammer/sear interfaces that upon a partial trigger pull, i.e., where the sear 2 is partially rotated but does not release the hammer 4, the two components must be returned to full engagement upon release of the trigger to prevent inadvertent discharge of the firearm. The critically of the components returning to full engagement upon release of the trigger thus further requires that the geometry and surface finishes of the hammer 4 and sear 2 be carefully and precisely machined and finished, such that the hammer and sear will regain full engagement in such a situation in which the trigger is released after a partial trigger pull without firing. Such precise and careful machining of these components, however, generally is more expensive and requires significant quality control and review to ensure that such parts are precisely machined to within specific, narrow ranges of tolerances necessary to provide a smooth interface and function.

Accordingly, it can be seen that a need exists for a new hammer/sear interface for hammer driven firearm trigger assemblies that addresses the foregoing and other related and unrelated problems in the art.

SUMMARY OF THE INVENTION

The present invention is directed to a roller sear/hammer interface for a firearm. In an exemplary embodiment, the sear has a roller rotatably mounted between two side plates forming a portion of the sear body. As the trigger is moved, a linkage connecting the trigger and sear causes the sear to pivot rearward such that the roller rolls along a notched surface formed in the hammer. This rolling action releases the hammer to strike a firing pin to fire a round of ammunition. Following the firing of the round of ammunition, the hammer is returned to the fully cocked position, after which the sear roller rolls downward into an engaged and locked position within the notch formed in the hammer.

In one aspect of the invention, a sear mechanism is provided for use in a hammer-driven firearm trigger assembly. The sear mechanism includes a body portion including a pair of opposed side plates; and a roller mounted between the side plates at an upper end of the side plates. The surface of the roller rolls along a notched surface formed in the hammer when a trigger is moved to release the hammer and strike the firing pin. The surface of the roller rolls along the notched surface in the opposite direction when the trigger is released.

In another aspect of the invention, a sear-hammer interface is provided for a firearm trigger assembly. The sear-hammer interface includes a hammer having a roller receiving notch formed along a rear surface; and a sear connected to the trigger assembly so as to pivot rearward in response to movement of a trigger. The sear has a roller mounted between a pair of opposed side plates. The roller rolls along an engaging surface of the notch formed in the hammer when the trigger is moved to release the hammer.

BRIEF DESCRIPTION OF THE DRAWINGS

The invention is better understood by reading the following detailed description of the invention in conjunction with the accompanying drawings.

DESCRIPTION OF THE INVENTION

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

The present invention generally is directed to an improved hammer/sear interface 10 (FIGS. 2 and 3) for hammer driven trigger assemblies or fire control systems T (FIGS. 4 and 5) of firearms F (FIG. 5) such as various types of long guns, including shotguns and rifles, handguns, and other types of firearms utilizing hammer driven trigger assemblies or fire control systems for firing rounds of ammunition therefrom. The present invention is further directed to providing a smoother and crisper trigger feel during operation of the hammer driven trigger assembly without requiring extensive surface finishing and precision milling or forming operations of the sear and hammer and the interface therebetween as is typically required with conventional hammer/sear interfaces for conventional hammer driven firearm trigger assemblies or fire control systems.

Figure 1:
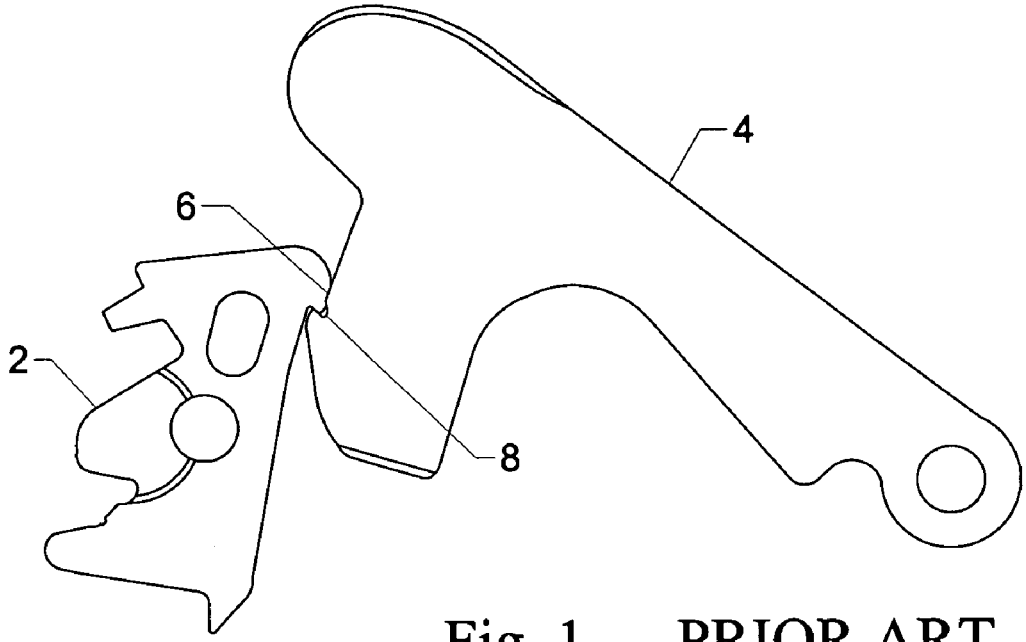
Fig. 1 PRIOR ART
FIG. 1 is a side elevation view of a conventional hammer/sear interface.
Figure 2:
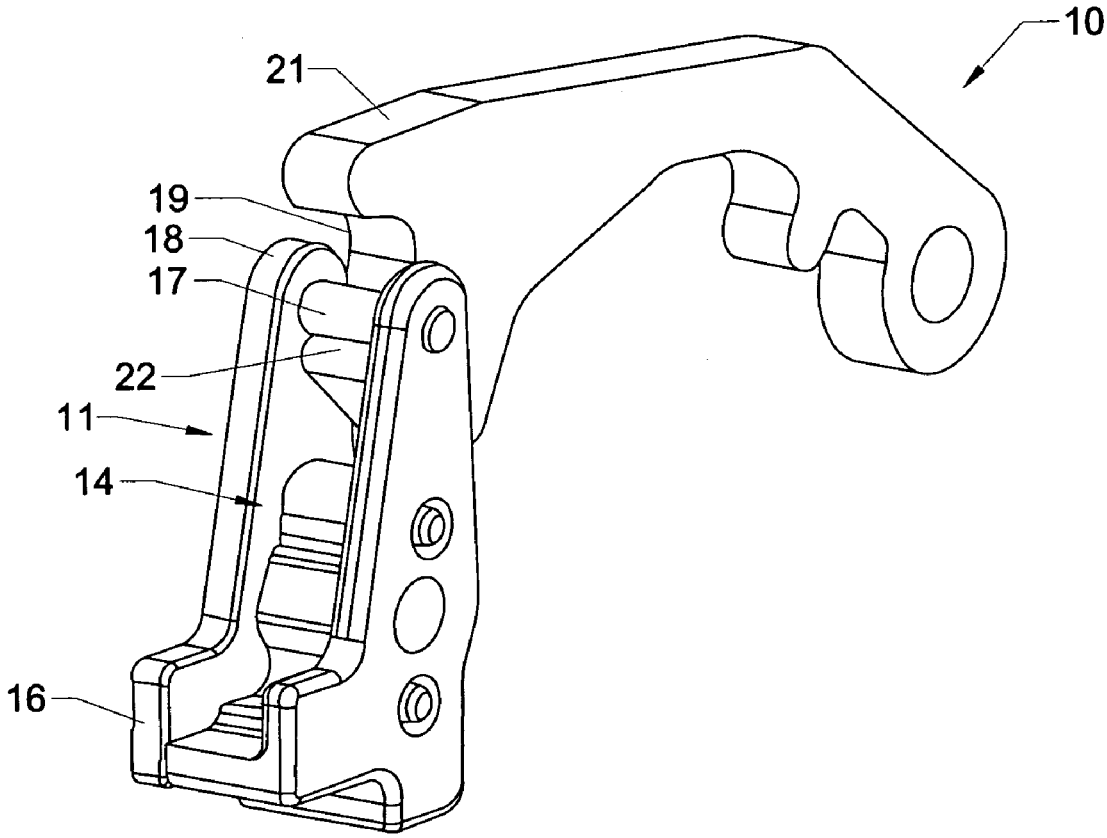
FIG. 2 is a perspective illustration of the roller sear/hammer interface of the present invention.
Figure 3:
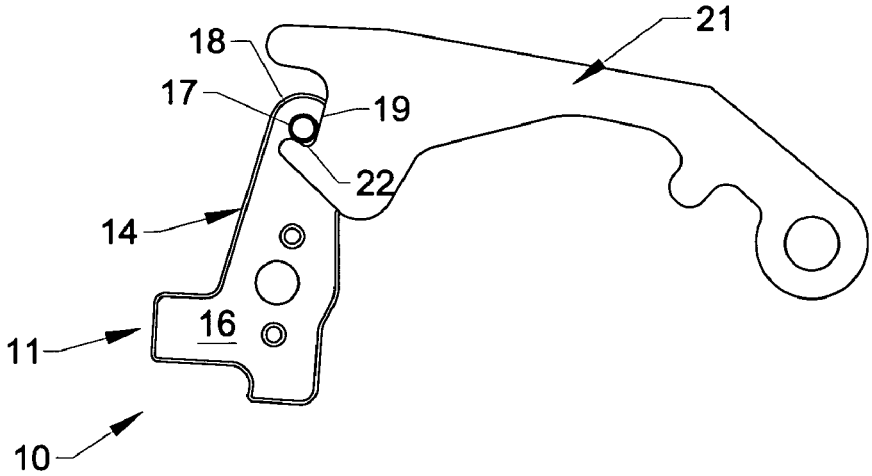
FIG. 3 is a side elevation view of the roller sear/hammer interface of the present invention with portions broken away for clarity.
Figure 4:
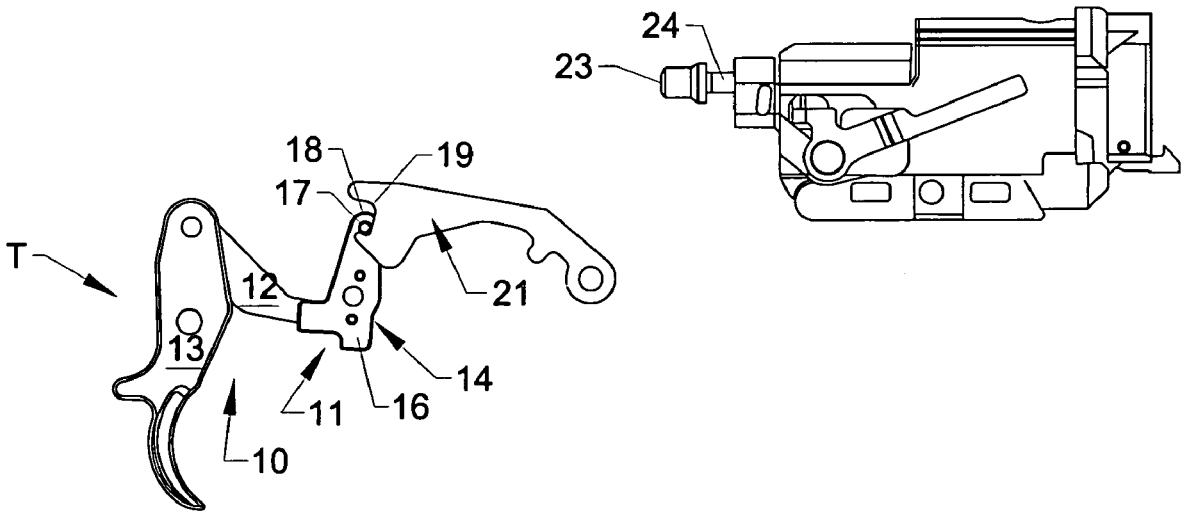
FIG. 4 is a schematic illustration of a hammer driven fire control or trigger assembly utilizing the roller sear/hammer interface of the present invention.
Figure 5:
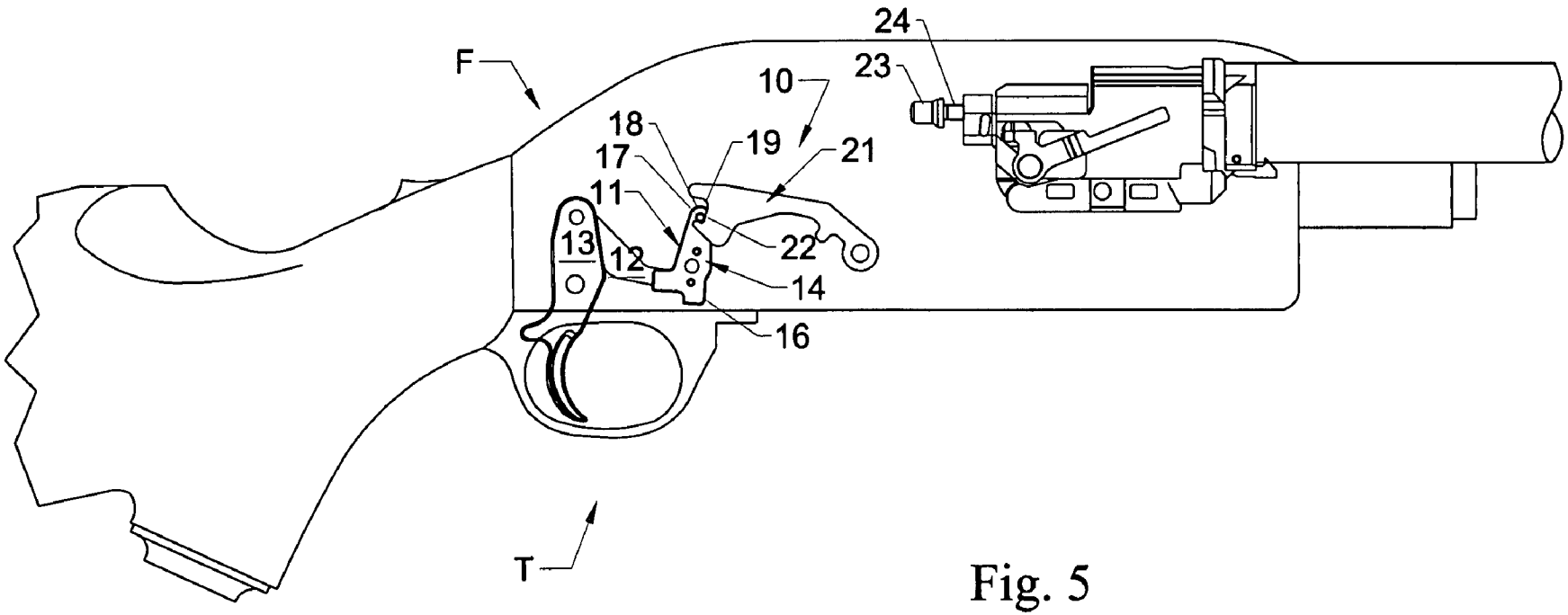
FIG. 5 is a side elevation view illustrating an example of the fire control trigger assembly utilizing the roller sear/hammer interface of the present invention mounted in a firearm.

As generally illustrated in FIGS. 2–5, the improved hammer/sear interface 10 of the present invention generally includes a sear 11 connected via a mechanical linkage 12 (FIGS. 4 and 5) to a trigger 13 of a firearm trigger assembly or fire control. As shown in FIG. 2, the roller sear 11 of the present invention generally includes a body portion 14, having a pair of opposed side plates 16, each typically formed from a metal such as steel or other durable, high strength materials and attached together via fasteners such as rivets, bolts or other similar fastening mechanisms. Alternatively, the body 14 can be stamped, milled, metal injection molded, or otherwise formed as a single, unitary piece or component. A roller or linear bearing 17 is rotatably mounted between the side plates at the upper ends 18 thereof so as to rotate upon movement of the sear 11 in response to movement of the trigger 13 of the firearm as indicated in FIGS. 4 and 5. As further shown in FIGS. 2 and 3, the roller or linear bearing 17 engages and rests in a notch 19 formed in a rear portion of a hammer 21 so as to engage and lock the hammer 21 in a cocked or ready position.

As indicated in FIGS. 4 and 5, as the trigger 13 is moved or pulled rearward, it will cause the linkage 12 between the trigger and the sear 11 to be moved forwardly, in turn causing the sear 11 of the present invention to be pivoted rearwardly. As the sear pivots rearward, the roller or linear bearing 17 will roll along the angled rearward surface 22 of the notch 19 formed in the hammer 21 so as to release the hammer from engagement by the sear. As the hammer is released, it will be urged forwardly by a hammer spring (not shown) and will strike the rearward end 23 of the firing pin 24 of the firearm, causing the firing pin to be moved forwardly and strike the primer of a round of ammunition (not shown) loaded within the chamber of the firearm to fire the round. Thereafter, as the hammer is moved back to its cocked, ready to fire position, upon release of the trigger, the roller 17 of the sear 11 again will be engaged by and roll downwardly into a fully engaged and locked position within the notch 19 of the hammer 21.

Accordingly, the roller sear/hammer interface of the present invention enables/allows greater tolerances in the machining of the hammer and sear, and the surface finishes thereof, than generally are required to form conventional sear and hammer components for a hammer driven trigger assembly or fire control system for firearms. The roller action of the present invention further generally will ensure a smooth rolling engagement as opposed to the frictional sliding engagement of conventional hammer/sear interfaces. Further, if the sear is subjected to a partial trigger pull and release, the roller design of the present invention also generally will regain its engaged and locked position with the hammer with less hesitancy, due to the reduced frictional aspects of the roller sear/hammer interface of the present invention.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A firearm, comprising:

a trigger;

a sear having a roller rotatably mounted thereto and connected to the trigger by a linkage so as to pivot toward the trigger in response to movement of the trigger;

a hammer having a roller receiving notch formed along a surface thereof for engaging the roller;

a firing pin adapted for engagement by the hammer; and wherein the roller of the sear rolls in direct contact along the surface of the notch formed in the hammer when the trigger is moved to release the hammer to strike the firing pin.

2. The firearm of claim 1 wherein the sear further comprises a pair of opposed side plates, the roller mounted between the side plates at an end thereof.

3. The firearm of claim 1 wherein the surface of the notch accommodates a rolling motion of the sear roller in both a clockwise and a counterclockwise direction.

4. The firearm of claim 1 wherein the roller rolls in an opposite direction along the notch of the hammer into a fully engaged and locked position within the notch of the hammer when the trigger is released.

5. The firearm of claim 1 wherein the roller rolls in an opposite direction along the notch of the hammer to return into an engaged and locked position when the trigger is released before the sear releases the hammer.

6. A hammer-driven firearm trigger assembly, comprising:

a hammer having a roller receiving notch formed along a surface thereof;

a sear mechanism connected to a trigger by a linkage and including a pair of opposed side plates, and a roller mounted between the side plates at an end of the side plates, wherein a peripheral surface of the roller rolls in direct contact along the notched surface formed in the hammer when the trigger is moved to release the hammer and rolls along the notched surface in an opposite direction to a locked position when the trigger is released.

7. The firearm trigger assembly of claim 6 wherein the sear mechanism is connected to the trigger by a mechanical linkage that causes the sear mechanism to pivot toward the trigger when the trigger is moved to release the hammer.

8. The firearm trigger assembly of claim 6 wherein the roller rolls in the opposite direction along the notch of the hammer to return into an engaged and locked position when the trigger is released before the sear releases the hammer.

9. The firearm trigger assembly of claim 6 wherein the opposed side plates are connected by fasteners.

10. The firearm trigger assembly of claim 6 wherein the opposed side plates are formed from a high strength material.

11. The firearm trigger assembly of claim 6 wherein the body portion is formed by any one of a stamping, a milling or an injection molding process.

12. A sear-hammer interface for a firearm trigger assembly comprising:

a hammer having a receiving notch formed along a surface thereof; and a sear having a roller mounted between a pair of opposed side plates and connected to the trigger assembly by a linkage so as to pivot toward a trigger in response to movement of the trigger, and wherein the roller rolls in direct contact along the surface of the notch formed in the hammer when the trigger is moved to release the hammer.

13. The sear-hammer interface of claim 12 wherein the roller is mounted between the side plates at an end of each plate.

14. The sear-hammer interface of claim 12 wherein the surface of the notch accommodates a rolling motion of the sear roller in both a clockwise and a counterclockwise direction.

15. The sear-hammer interface of claim 12 wherein the roller rolls in an opposite direction into an engaged and locked position within the notch of the hammer when the trigger is released.

16. The sear-hammer interface of claim 12 wherein the roller rolls in an opposite direction along the notch of the hammer to return to an engaged and locked position when the trigger is released before the sear releases the hammer.

17. The sear-hammer interface of claim 12 wherein the trigger assembly comprises the trigger and a mechanical linkage that couples the sear to the trigger.

18. The sear-hammer interface of claim 12 wherein a mechanical linkage causes the sear to pivot towards the trigger, thereby engaging the notch to release the hammer when the trigger is moved.

* * * * *